United States Patent [19]

Patzner

[11] 4,009,579

[45] Mar. 1, 1977

[54] METHOD FOR CONSTRUCTING A TUNNEL OR UNDERPASS

[76] Inventor: Delbert M. Patzner, 301 N. Main, Rochelle, Ill. 61068

[22] Filed: Dec. 8, 1975

[21] Appl. No.: 638,694

[52] U.S. Cl. ..... 61/42; 61/45 R; 61/85; 175/62

[51] Int. Cl.[2] ..... E21D 9/04

[58] Field of Search ..... 61/42, 43, 44, 45, 16, 61/84, 85; 175/62

[56] References Cited

UNITED STATES PATENTS

| | | | |
|---|---|---|---|
| 620,101 | 2/1899 | Carpenter | 61/42 X |
| 1,098,766 | 6/1914 | Scully et al. | 61/16 |
| 3,631,680 | 1/1972 | Thomson | 61/42 |

*Primary Examiner*—Jacob Shapiro
*Attorney, Agent, or Firm*—Gary, Juettner et al.

[57] ABSTRACT

Method of constructing a tunnel under an existing structure, such as railroad tracks, without disruption of the existing structure, i.e. without interrupting railroad service on the tracks and without requiring construction of expensive track run arounds. The method comprises the steps of boring or drilling a plurality of pipes in side-by-side relationship generally horizontally beneath the railroad right-of-way; if need be, reinforcing the pipes to assist in carrying incremental components of the loading on the tracks; incrementally excavating a small segment of the tunnel immediately beneath said pipes and placing tunnel forming members in the excavated segment in supporting relationship with the pipes; and repeating the last two steps until the tunnel, complete with tunnel forming-pipe supporting members, extends beneath the railroad tracks and right-of-way.

15 Claims, 7 Drawing Figures

13&15
50
16
25
26
24
62
51
58
52
20
64
54

26
12&14
13&15
16
6.
7.
74
62
25
70
58
23
22
72
64
20
73

16
25
46
41
62
70
40
48
39
58
60
23
20
72
64
54

44
42
25
50
51
56
62

METHOD FOR CONSTRUCTING A TUNNEL OR UNDERPASS

BACKGROUND OF THE INVENTION

The invention relates to a method of constructing a tunnel or underpass beneath an existing construction, and more particularly to a method of tunneling a railroad underpass without disrupting or requring change in existing track construction, and without interrupting railroad service on the tracks.

Often times it is desired for both safety and convenience to establish a pathway or roadway over, through or under an existing structure. In order to do so, it has been necessary to disrupt the existing structure. For example, should it be desired to build a roadway over or under a set of railroad tracks, the use of the tracks is interrupted for the duration of construction, or at least for long intervals, to permit construction of a bridge over or an underpass beneath the tracks. Service must be halted.

Another approach, useable only in some locations, is to provide alternative, temporary routing for the railroad tracks, called a run around. However, such approach requires availability of adjacent land for placement of the alternative roadbed or run around; at least temporary disruption of use of the tracks when the connection and disconnection of the temporary tracks is made; and continued interruptions and delays in service while trains traverse the temporary tracks, inasmuch as the run around is not usually built to the same standards as the permanent tracks and contains fairly sharp curves. More important, the acquisition of land and construction and removal of the temporary tracks adds greatly to the expense of constructing the bridge tunnel or underpass. In fact, many needed underpasses are not constructed because disruption of use of the railroad is not tolerable, and insufficient funding is available for construction of both the underpass and the run around.

While it has been suggested before that a tunnel could be constructed beneath railroad tracks without disruption of service, see for example U.S. Pat. Nos. 3,438,208 and 3,631,680, the methods and techniques suggested required in-ground placement of extremely large bodies, unconventional and esoteric construction methods, and elaborate, specialized equipment not available to general construction contractors. The proposals simply were not feasible or practical. Construction of run arounds would be far less costly.

SUMMARY OF THE INVENTION

The present invention provides a method for constructing tunnels and underpasses quickly and inexpensively, with conventional readily available equipment, without disrupting existing constructions and without interrupting or delaying service thereon. The method of the present invention is particularly well suited to construction of tunnels and underpasses beneath railroad tracks and highways without disrupting travel on the tracks and roads and without the need for expensive track or road run arounds. The method of the invention facilitates replacement of hazardous and expensive-to-maintain guarded railroad crossings with safe and convenient underpasses.

The method of the invention comprises the steps of drilling, augering or boring a plurality of pipes or similar support members horizontally beneath the railroad right-of-way or other existing structure, the pipes or support members being inserted one by one in side-by-side closely adjacent relationship at a level slightly above and spanning the entire area of the top wall of the tunnel to be formed. If necessary or desired, some or all of the pipes, after they have been drilled or bored into place, may be reinforced with prestressed cables and concrete. After the pipes have been so placed, the earth beneath the pipes is excavated away to the desired tunnel width and heighth dimensions, but only incrementally, i.e., only a few feet in length at one time. As each increment of excavation is completed, easily handled tunnel forming members are placed in the excavation beneath the pipes in supporting relation thereto. The last two steps of incremental excavation and placement of tunnel members are repeated until the tunnel is completed.

Thus, during the entire time of construction of the tunnel, all but a few feet of the pipe are fully supported in place by the earth in which they are embedded and the tunnel forming members; the railroad bed and tracks or other existing structure is fully supported by the pipes and can continue to be used normally without interruption in service or travel; and the pipes support the earth in place and prevent cave-ins during tunneling, thereby assuring the safety of the workers constructing the tunnel.

Moreover, the pipes or other support members are inserted in the earth by entirely conventional, relatively light weight and readily available earth boring or drilling machines. Once the pipes have been bored, augered or drilled into place in side-by-side relation beneath the existing structure, any conventional, readily available excavating machine, for example a tractor mounted back hoe, can be used to effect incremental removal of the earth from under the pipes. Tunnel forming members may then be easily placed in the excavation, by hand or by machine, in supporting relationship to the pipes or support members; whereby the pipes are continuously supported except over a few feet of their lengths, and the pipes in turn support the overburden and existing structure thereabove and prevent cave-ins and other displacement of the overburden into the tunnel. Consequently, the method may be economically, efficiently and safely practiced by almost any contractor without need for special equipment.

The primary object of the present invention, therefore, is to provide a method for inexpensively and safely constructing a tunnel or underpass beneath an existing structure without disrupting normal use of the existing structure.

Another object of the invention is to permit the safe construction of a tunnel or underpass beneath continuously used railroad tracks or roads without the need for alternative temporary routing of the tracks or road.

Yet another object of the invention is the provision of an improved tunnelling method characterized by the convenient and economical placement of pipes or similar supporting members beneath the entire existing structure prior to excavating the tunnel or underpass opening.

Still another object of the invention is to place said supporting members beneath the existing structure with no or minimum disturbance thereto and without the need for large specially build equipment.

These and other objects of the method for constructing a tunnel or underpass pursuant to the present invention will become apparent from the following written description and accompanying drawings.

DETAIL DESCRIPTION OF THE PREFERRED METHOD

Figure 1:
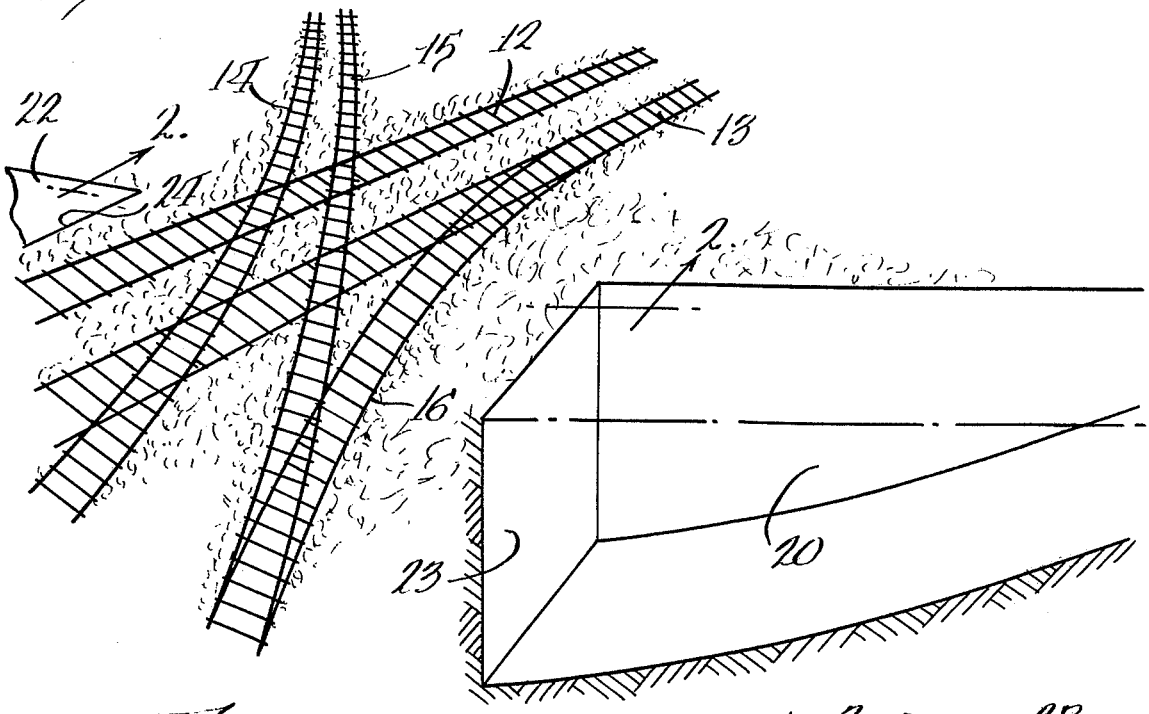
FIG. 1 is a perspective view of a railroad track site being prepared for construction of a tunnel or underpass using the method of the present invention.

Referring to FIG. 1, the method of constructing a tunnel or underpass under an existing structure without disrupting continued use of the structure or requiring temporary alternative structures is particularly suited for construction of a tunnel or underpass under railroad tracks, such as plural sets of tracks 12, 13, 14, 15 and 16. As the tunnel is constructed with the tracks continuing to be used, without the need for constructing expensive track run arounds, use of the method of the present invention is particularly advantageous where the tracks are heavily used and in a complicated arrangement, such as the double track crossing of FIG. 1. The method of the present invention has the further advantage of permitting placement of the tunnel at or near the narrowest span or distance between the outermost tracks so that the length of the tunnel, and hence its cost, may be held to a minimum. Further, as the ground under the tracks is well compacted and well supported during practice of the invention, the tunnel entrances may be located close to the railroad tracks, even as close as a foot or two away, still further reducing tunnel length and cost.

In practice of the method, approachways 20 and 22 for a roadway to be built under the tracks are made by excavating the earth to predetermined configurations on either side of the tracks; the earth being excavated to form generally vertical frontal or entrance walls 23 and 24. Generally, the depth of the excavation depends on the surrounding terrain and the type of tunnel to be built. For conventional vehicle tunnels, the excavation need be only a few feet deeper than the height of the tunnel since, by practice of the present method, it is usually possible to construct the tunnel only a few feet below the tracks.

Figure 2:
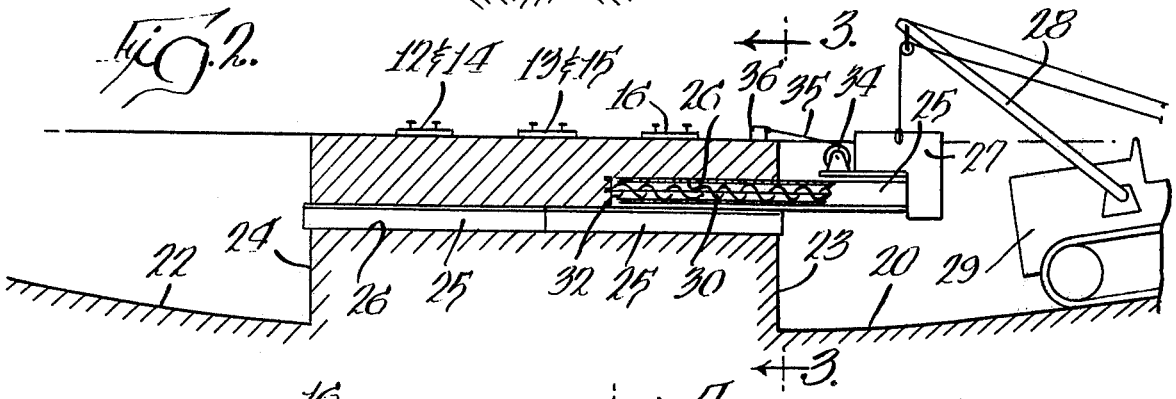
FIG. 2 is a cross-sectional view taken substantially on and in the direction of line 2 — 2 of FIG. 1, illustrating somewhat schematically the placement of pipes or similar supporting members beneath the railroad tracks.

Referring to FIG. 2, after the approachways 20 and 22 have been excavated, a pipe boring machine 27 is brought or carried into position in one of the approachways to bore a plurality of support members 25, preferably tubular pipe, into the earth below the existing structure. Each pipe or support member 25 is of a length somewhat greater than the length of the tunnel to be formed and extended through the earth from one frontal or entrance face 23 to the opposite entrance face 24; and a sufficient number of pipes or support members are bored through in side-by-side relation to span a width dimension somewhat greater than the width of the tunnel to be formed.

To facilitate the use of conventional boring machines and simultaneous boring of holes and placing of support members therein, the support members are preferably tubular pipe of desired diameter, wall thickness and length. The pipe may thus serve as a support for the augering or boring tool and also as an exit conduit for the earth materials that are being removed. The pipe diameter may, for example, range from about 6 inches to 30 inches, or more, and the wall thickness is selected to support the overburden, the right of way and the moving stock on the right of way. To facilitate handling, the pipe may be supplied in incremental units of length to be welded on the job site to form pipes of the necessary overall length to span the distance from one entrance wall 23 to the other entrance wall 24. The pipes are bored into place at an elevation slightly above the top wall or roof of the tunnel to be formed and generally parallel to the roof. Usually, the pipes will be placed horizontally inasmuch as tunnels are usually horizontal, or substantially so.

In placing the pipes 25, the excavated approachways 20 and 22 provide the only access necessary for the boring equipment. Unlike prior techniques, no special equipment is needed. Instead, a small, conventional boring machine 27, such as CRC-CROSE, Model RB-6-30 road boring machine capable of boring openings of 6 to 30 inches in diameter, may be used. The machine 27 may be suspended from a boom 28 mounted on a crawler tractor 29, or may be supported from a railroad work car positioned on the tracks above the tunnel site. The boring machine rotatably drives a flight auger 30 which extends horizontally (i.e., parallel to the roof of the tunnel to be formed) from the machine to the entrance wall 23. The forward end of the auger 30 carries a rotating cutter head 32 of a suitable type for the soil to be encountered, be it rock, clay or sand. The machine 27 carries an incremental length of the pipe 25, with the auger 30 extending rotatably through the pipe and with the cutter head extending from the end of and beyond the periphery of the pipe. As boring progresses, a winch 34 mounted on the boring machine draws or pulls on a cable 35 anchored at 36 to draw the machine 27 toward the entrance wall 23 and thereby drive the pipe 25, auger 30, and cutting head 32 into the earth below the tracks.

As the cutting head 32 is rotated and drawn into the ground, it cuts through the earth materials, which in turn are driven by the auger 30 through the pipe and out the outer of right hand end thereof. When the boring machine 27 has been drawn close to the wall 23, it is removed and another incremental length of pipe 25 is welded to the section already in the ground. Also, another section of auger 30 is added to and coupled with the preceding sections. The machine 27 is then recoupled with the added sections of pipe and auger and boring is continued in the manner described until the head 32 and the forward end of the pipe 25 exit through the wall 24 into the approaching 22, at which time the pipe extends beneath all of the tracks 12, 13, 14, 15 and 16.

The cutting head 32 and the auger 30 may then be removed via the forward end of the pipe 25 and returned to the approaching 20 for use in boring the next adjacent one of the pipes 25 into place.

Figure 3:
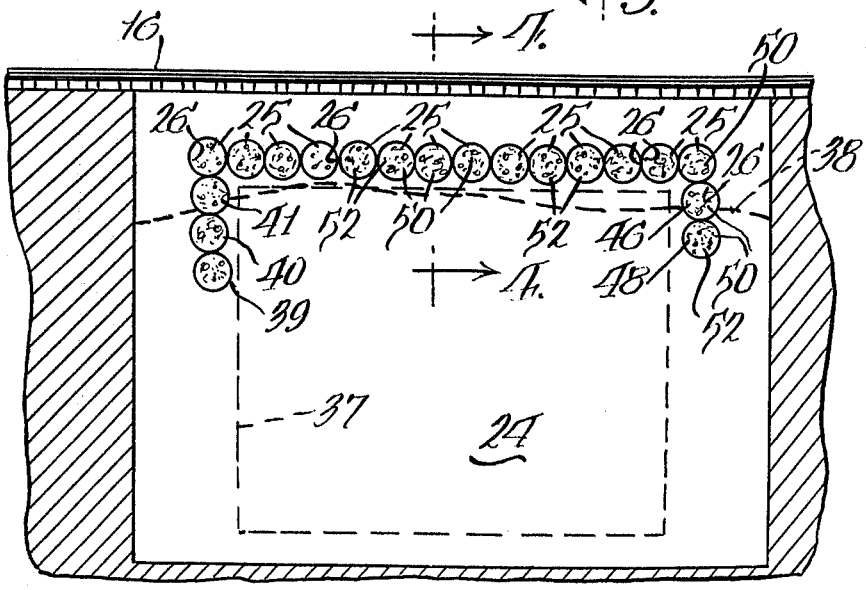
FIG. 3 is an enlarged frontal view of the tunnel site taken substantially on and in the direction of line 3 — 3 of FIG. 2, illustrating the pipes or support members in position.

In boring the first pipe into position as above described, certain factors should be taken into consideration. In particular, if the first pipe can be placed with great accuracy, all subsequent pipes can be guided from the first pipe and easily bored into highly accurate placement. Thus, the location selected for the first pipe can be important. In this regard, it is desirable that the first pipe be placed in clay, or clay like material, rather than rock or loose aggregate, as it is easiest to accurately control the boring operation in clay. Should clay not be present at the location in which it is desired to place the pipes 25 forming the tunnel roof support, but clay is located nearby, it may be feasible to start in the clay and proceed from there. For example, in FIG. 3 a typical situation is illustrated wherein a layer of clay 38 lies below an overlying layer of loose earth and/or aggregate. In this environment, a first skirt pipe 39 may be placed off to one side of the proposed tunnel site (shown in dashed lines at 37). Then subsequent skirt pipes 40 and 41, as needed, may be placed vertically above the first skirt pipe 39 (each deriving guidance from the pipe therebelow) until the the desired height location for the roof support pipes 25 is reached. Then, the roof support pipes 25 may be placed side by side, with each deriving guidance from the previously placed pipe. In this manner, accurate placement of the pipes is assured. Also, during excavation of the tunnel, the skirt pipes 39, 40 41, etc. will be of great value in insuring against cave-ins.

Figure 7:
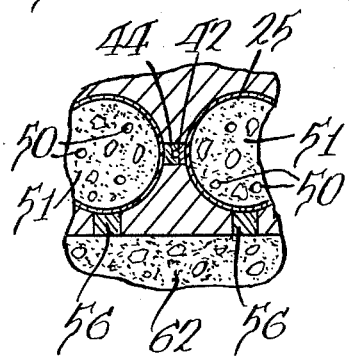
FIG. 7 is an enlarged cross-sectional view taken substantially on and in the direction of line 7 — 7 of FIG. 5.

To aid in guiding the location of one pipe with respect to the immediately preceding adjacent pipe, guide means, such as the tongue and groove elements 42 and 44 shown in FIG. 7 may be provided. The corner pipes 25 would have their tongue and groove elements spaced 90° apart, while other pipes would have the elements spaced 180° apart. The guide means 42 and 44 also help hold the pipes sufficiently spaced apart to prevent the cutting head 32 from striking the previously placed pipe. Sufficient skirt pipes 46, 48, etc. may be driven on the other side of the proposed tunnel site so that the last skirt pipe 48 is also in solid clay material. Thus, the skirt pipes and the support pipes 25 completely isolate the proposed tunnel excavation from loose overburden and prevent cave-ins.

Sufficient numbers of the pipes 25 are placed longitudinally of and parallel to the roof of the proposed tunnel to extend completely beyond the width of the proposed tunnel. For example, assuming a tunnel of a width of approximately 10 feet is to be formed, such supportive roof could be made by placing fourteen 12 inch diameter pipes across the width, or 724 inch diameter pipes, etc. The diameter of the pipes used and the wall thickness thereof are determined by the maximum load the the pipes must carry and the maximum unsupported length or span to be encountered during the subsequent incremental excavation of the tunnel.

Should the loads to be carried by the pipes be high, as the pipes are placed in position or after placement of all pipes is completed, some or all of the pipes may be further reinforced by passing tension cables 50 (FIGS. 4 and 7) through the pipes, affixing end plates to the pipes, pre-stressing the cables, and filling the interiors of the pipes with concrete 51 to convert the pipes to cable-reinforced, pre-stressed beams.

Figure 4:
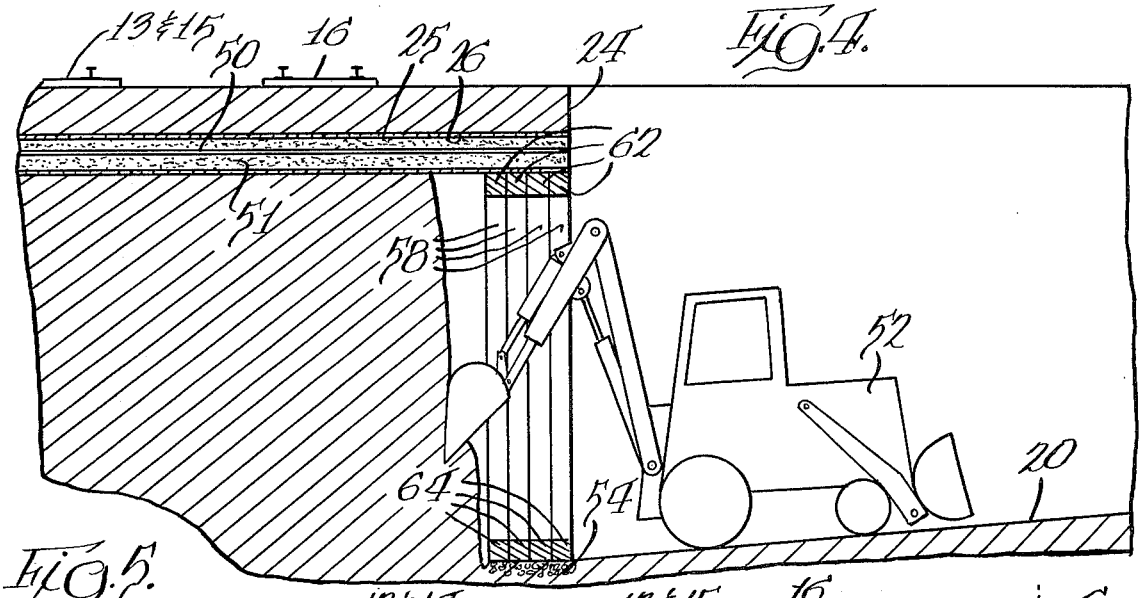
FIG. 4 is a partial cross-sectional view taken substantially on and in the direction of line 4 — 4 of FIG. 3, illustrating the incremental excavation and periodic placement of tunnel forming members beneath the support members.

After all of the support pipes 25 and the skirt pipes have been bored under the existing structure or tracks, excavation of the tunnel opening is started. Referring to FIG. 4, the excavation is carried out segmentally or incrementally so that at most there is only a short span of a few feet, say 2 feet, of the length of the support pipes 25 that is unsupported at any given time. As shown in FIG. 4, a conventional excavating machine such as a backhoe 52 may be moved into the approachway 20 and used to excavate the material beneath the support members. The hoe or other machine is used to remove the earth material over the full width and heighth dimensions of the tunnel, but only a foot or two of the length dimension at a given time. After such incremental excavation has been made to the desired depth, and the excavated earth trucked away, the foundation base 54 for the floor of the tunnel is put in place. Surveyors' or construction sightings are then taken to determine whether the support members 25 are at the proper elevation. Where necessry, shims 56 (FIG. 7) of varying thicknesses may be secured, as by welding, to the lower surface of the support pipes 25.

Prefabricated tunnel forming members or elements 58, 60, 62 and 64 are then brought into the excavated portion and set up therein. The tunnel forming members may be prestressed reinforced concrete elements which may, for example, measure approximately one foot by one foot in cross-section and of lengths corresponding to the height and width dimensions of the tunnel. Each incremental, longitudinal unit of the length of the tunnel is formed by a floor member 64, tow side members 58 and 60, and a roof member 62. The tunnel forming members may be jointed to one another, as by dowel pins, angle irons, bolts, etc. When in place, the roof member 62 of each set of tunnel forming members engages the pipes 25 and/or the pipe shims 56 thereby to support those portions of the pipes beneath which excavation has taken place, whereby the pipes are at all times firmly supported in the ground and/or by the members 58, 60, 62 and 64.

Preferably, said tunnel forming members are equipped with fittings (not shown) facilitating manipulation and placement thereof by machine, i.e., by a tractor or bull dozer equipped with controls for raising, lowering, turning and twisting the individual beams 58, 60, 62 and 64, so that the same may be easily, quickly and economically installed in place. After the first set of tunnel members has been installed, the next increment of excavation is effected to accommodate installation of the next set of tunnel members. These alternate steps of excavation and installation of tunnel forming members are repeated until several sets of the tunnel forming members are in place. For example as shown in FIG. 4, after four sets of the tunnel forming members are set in place to form a longitudinal section of tunnel approximately 4 feet long, grouting may be injected behind the members into the space between the members and ground and between the members and the pipes 25 thereby to secure the members to one another and the pipes and in place in the ground. After grouting, excavation continues and the above steps are repeated until the tunnel extends completely beneath the tracks from the approachway 20 to the approachway 22.

Thus, a tunnel is conveniently, expeditiously and economically installed beneath the sets of railroad tracks 12, 13, 14, 15, 16 or other existing structures without disrupting or even interrupting travel on or use of the existing structure.

If it is desired to expedite construction of the tunnel, incremental excavation and placement of tunnel forming members may and preferably does proceed simultaneously from both ends, i.e., from both of the approachways 20 and 22, with the two crews meeting at approximately the middle of the tunnel. In this event, the roof support pipes 25 are firmly supported to each side of each of the two excavations, firmly support without disturbance the overburden and the tracks, and prevent cave-ins at both excavation sites.

Also, when working in particularly loose soils, aggregates and the like, it may prove advisable to make at least a few careful initial excavations and placements of tunnel forming members at each end of the tunnel site to insure alignment and firm support of both ends of the pipes 25 before commencing further excavation, especially where tunneling is to proceed principally from one end of the tunnel site.

Figure 5:
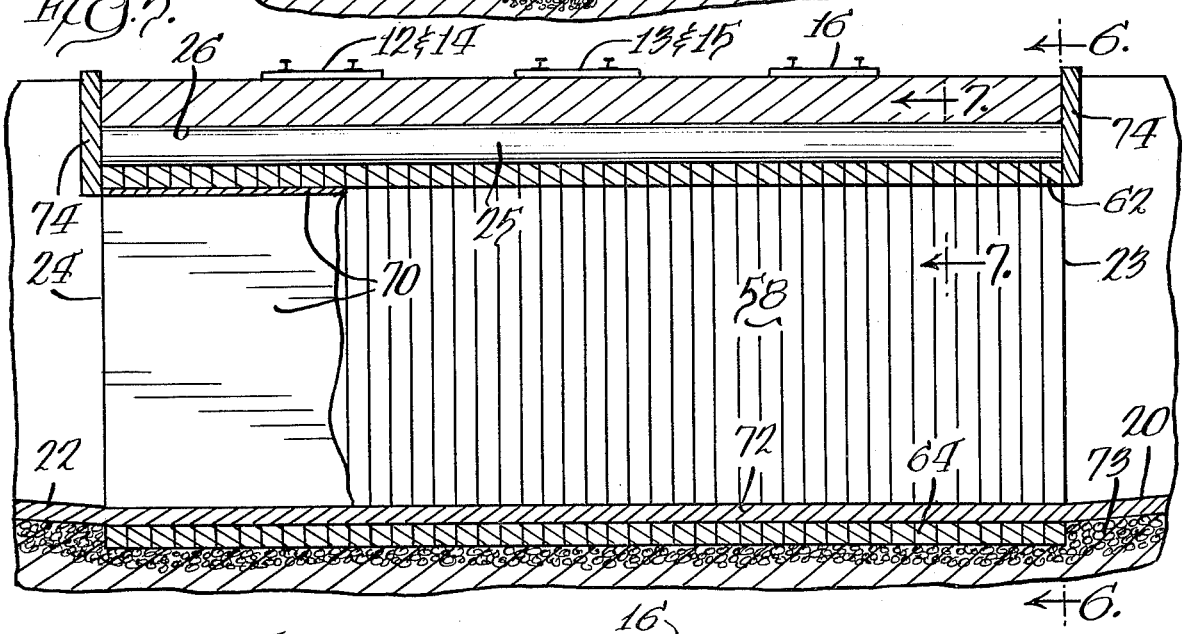
FIG. 5 is a cross-sectional view taken in substantially the same direction as FIG. 4, but showing the complete tunnel.
Figure 6:
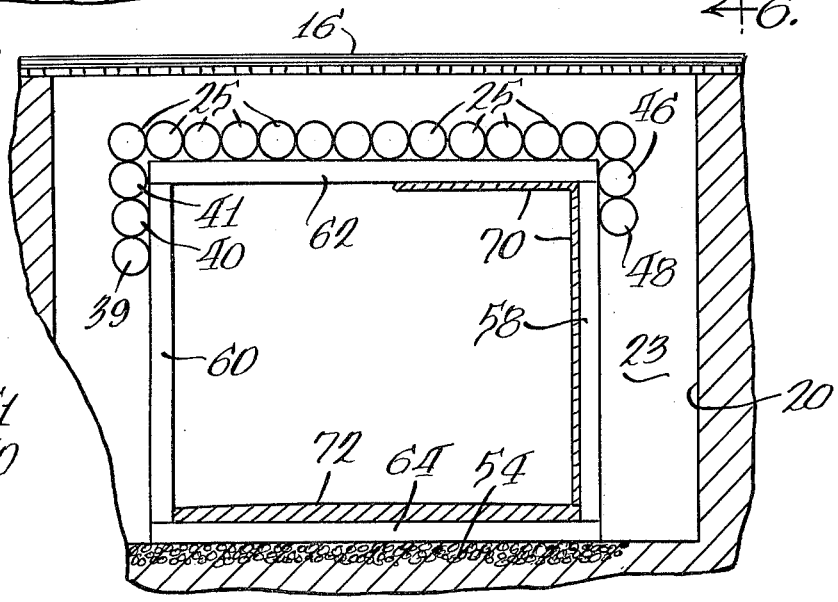
FIG. 6 is a frontal view of the completed tunnel taken substantially on and in the direction of line 6 — 6 of FIG. 5.

After the tunnel has been extended entirely beneath the tracks 12, 13, 14, 15, 16 from one approachway to the other, the tunnel and the approachways may be finished in any conventional manner to complete the tunnel; the support pipes and the skirt pipes remaining in place to contribute to the structural strength of the tunnel. As shown for example in FIGS. 5 and 6, a finish coat of concrete or cement 70 may be applied to the roof and sides of the interior of the tunnel members to enhance their appearance. Also, a roadway 72 of suitable material may be paved onto the bottom of the approachways 20 and 22 and the tunnel floor members 64; an adequate foundation base 73 being provided in the approach sections before the pavement is put in. To further enhance the appearance of the tunnel, the frontal or entrance walls may be given a concrete surfacing 74, to cover the exposed ends of the support and skirt pipes and to finish off the tunnel entrances. Likewise the approachways could be completed with concrete side walls (not shown) to help retain the ground.

As is apparent from the foregoing, the support pipes and the skirt pipes fully support and carry the earth and/or structure above the pipes so that the load carrying capacity of the ground above the tunnel is not diminished and there is no need to cease use of the existing structure, railroad tracks, highway, etc. Further, as the unsupported span beneath the support members 25, i.e., the longitudinal distance between the supporting burden and the tunnel forming members, is short, preferably on the order of a few feet at most, there is no danger created either to the workers in the tunnel or to passing trains using the existing tracks.

In the foregoing description, the preferred made of practicing the invention has been set forth so as to enable those skilled in the art to use the same, but it is to be appreciated that various modifications and changes may be made therein. For example, while support and skirt pipes of identical size have been shown, pipes of different sizes could be used; if soil conditions permit, skirt pipes need not be used; tunnel forming members of different sizes, shapes and characteristics could be employed; and the general technique can be used to place tunnel and passageways through elevated railway and roadway embankments and under other existing structures, such as buildings.

Thus, while only the preferred method of constructing a tunnel or underpass in accord with the present invention has been illustratred and described, it is to be understood that modifications, variations and equivalent steps, techniques, tools and apparatus could be utilized, all without departing from the scope of the invention as defined by the appended claims.

What is claimed is:

1. A method of constructing a tunnel or underpass beneath an existing structure comprising the steps of:

inserting a plurality of longitudinal support members side by side through the ground beneath the existing structure so that the support members extend continuously beneath the structure from side to side thereof and overlie the roof of the tunnel to be formed, after the support members are in place, excavating a longitudinal increment of the ground beneath the support members, installing tunnel forming means beneath the support members in place of each longitudinal increment of excavated ground to support the support members, and repeating the latter two steps until the earth has been excavated from beneath the full length of the support members and the tunnel forming means extends from one side of the structure to the other, whereby the existing structure is continually supported by the support members during the entire period of construction of the tunnel, and the tunnel is constructed without interfering with substantially normal use of the existing structure.

2. The method of claim 1, wherein the step of inserting the support members comprises boring into the ground parallel to the roof of the tunnel to be formed and moving the support members into the bored openings.

3. The method of claim 2, wherein the support members are pipes and the boring is accomplished by a boring machine having an auger extending through the pipe and a cutting head extending from the lead end of the pipe.

4. The method of claim 1, wherein each incremental step of excavating the ground beneath the support members comprises removing the burden over the full width and heighth dimensions of the tunnel but no more than a few feet in the longitudinal direction of the tunnel.

5. The method of claim 1 wherein the step of installing tunnel forming means comprises moving preformed roof, floor and side elements into the tunnel and erecting and securing them to each other and adjacent elements.

6. The method of claim 1, wherein the existing structure comprises railway tracks or a roadway located at substantially ground level, and the method includes the preliminary step of preparing approachways on each side of the tracks or road by excavating the ground on each side thereof to a level therebelow and downwardly to locating positions for insertion of the support members below the railway tracks or roadway.

7. The method of claim 1, wherein the existing structure comprises railway tracks or a roadway elevated on an embankment above ground level, and the method includes the preliminary step of preparing tunnel approachways by the establishment of locating positions for insertion of the support members below the railway tracks or roadway.

8. A method for constructing a tunnel or underpass beneath existing railway tracks or a roadway without disrupting use of the existing tracks or roadway, comprising the steps of:

preparing an approachway on each side of the existing structure, locating positions for support members beneath the existing structure, boring substantially horizontal openings one at a time at located positions beneath the existing structure from one approachway to the other, inserting a pipe in each bored opening, repeating the latter two steps until sufficient pipes are placed beneath the existing structure so that pipes are placed side by side over the roof of the tunnel to be formed, after the pipes are in place, excavating a longitudinal incremental of the burden from beneath the pipes, installing preformed tunnel forming roof, floor, and side elements in each longitudinal increment of excavated space and positioning said tunnel forming elements to support the pipes, and repeating the latter two steps until the burden has been excavated from beneath the full length of the pipes and said tunnel forming elements extend completely beneath the existing structure from one approach way to the other, whereby the existing railroad track or roadway is continuously supported by the pipes during the entire period of construction of the tunnel without interfering with substantially normal use of the tracks or roadway and without the need for temporary run arounds for the tracks or roadway.

9. The method of claim 8, comprising the further step of reinforcing at least some of the pipes prior to excavation.

10. The method of claim 9, wherein the step of reinforcing comprises installing tension cables in at least some of the pipes and filling the same with concrete.

11. The method of claim 8, further comprising the step of periodically grouting the tunnel forming members in place.

12. The method of claim 8, further comprising the step of accurately positioning a first pipe in place and guiding each subsequent pipe into place from a previously placed pipe.

13. The method of claim 8, further comprising the step of extending skirt pipes beneath the existing structure generally vertically one above the other outwardly of the sides of the tunnel to be formed.

14. The method of claim 8, wherein the step of placing the pipes comprises the placing of a first pipe in clay and guiding subsequent pipes into position from previously placed pipes.

15. A method of constructing a tunnel or underpass beneath an existing structure comprising the steps of:

inserting a plurality of longitudinal support members side by side through the ground beneath the existing structure so that the support members extend continuously beneath the structure from side to side thereof and overlie the roof of the tunnel to be formed, after the support members are in place, excavating a longitudinal increment of the ground beneath the support members, installing means beneath the support members in place of each longitudinal increment of excavated ground to support the support members at each side of the tunnel, and repeating the latter two steps until the earth has been excavated from beneath the full length of the support members and a tunnel extends from one side of the structure to the other, whereby the existing structure is continually supported by the support members during the entire period of construction of the tunnel, and the tunnel is constructed without interfering with substantially normal use of the existing structure.

* * * * *